US010891844B1

(12) United States Patent
Trunzo et al.

(10) Patent No.: US 10,891,844 B1
(45) Date of Patent: Jan. 12, 2021

(54) ELECTRONIC BRACELET AND AN OFFENDER MONITORING SYSTEM

(71) Applicant: UPSTREEM, Jumet (BE)

(72) Inventors: Luciano Trunzo, Leval-Trahegnies (BE); Pierre Blondeau, Thines (BE)

(73) Assignee: UPSTREEM, Jumet (BE)

( * ) Notice: Subject to any disclaimer, the term of this patent is extended or adjusted under 35 U.S.C. 154(b) by 0 days.

(21) Appl. No.: 16/975,802

(22) PCT Filed: Feb. 19, 2019

(86) PCT No.: PCT/EP2019/054112

§ 371 (c)(1),
(2) Date: Aug. 26, 2020

(87) PCT Pub. No.: WO2019/166286

PCT Pub. Date: Sep. 6, 2019

(30) Foreign Application Priority Data

Feb. 27, 2018 (EP) ..... 18158819

(51) Int. Cl.
*G08B 21/02* (2006.01)
*G08B 25/01* (2006.01)

(52) U.S. Cl.
CPC ..... *G08B 21/0261* (2013.01); *G08B 21/0269* (2013.01); *G08B 21/0286* (2013.01); *G08B 21/0288* (2013.01); *G08B 25/016* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,438,319 | A | 8/1995 | Zeytoonjian | |
| 6,405,213 | B1 | 6/2002 | Layson et al. | |
| 7,123,141 | B2 * | 10/2006 | Contestabile | G08B 21/0269 340/539.13 |
| 2010/0238024 | A1 | 9/2010 | Derrick et al. | |
| 2014/0218537 | A1 * | 8/2014 | Nepo | G08B 25/009 348/158 |
| 2016/0232772 | A1 * | 8/2016 | Shechter | G08B 21/0236 |
| 2016/0234668 | A1 * | 8/2016 | Lee | G06F 3/14 |
| 2017/0084149 | A1 * | 3/2017 | Spikes | G08B 21/0288 |
| 2019/0340906 | A1 * | 11/2019 | Williams | G08B 15/00 |

OTHER PUBLICATIONS

Int'l Search Report for PCT/EP2019/054112, dated May 17, 2019.

* cited by examiner

*Primary Examiner* — Travis R Hunnings
(74) *Attorney, Agent, or Firm* — Blue Filament Law PLLC

(57) ABSTRACT

An electronic bracelet and an offender monitoring system. The electronic bracelet comprises a monitoring device, a strap configured for attaching the monitoring device to a wrist of an offender and a tamper detection device for detecting a bracelet attachment error. The monitoring device of the electronic bracelet communicates with a central monitoring station and with a home station. The monitoring device is configured for displaying instructions on a screen of the monitoring device. The instructions are related to for example a violation of home curfew rules or a violation of geographical restriction rules. The electronic bracelet allows for both monitoring an offender inside and outside the offenders residence.

15 Claims, 4 Drawing Sheets

ELECTRONIC BRACELET AND AN OFFENDER MONITORING SYSTEM

FIELD OF THE INVENTION

Figure 1:
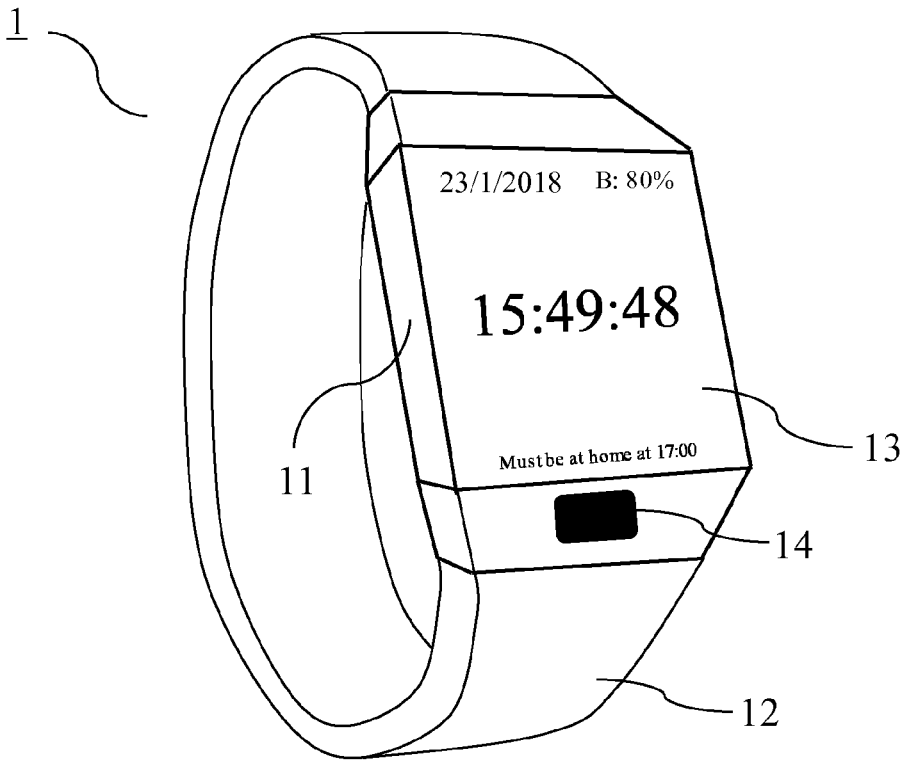

The present invention relates to an electronic bracelet for monitoring an offender, more specifically it relates to an electronic bracelet comprising a monitoring device and a strap configured for attaching the monitoring device to a wrist of an offender.

The present invention also relates to an offender monitoring system comprising the electronic bracelet.

DESCRIPTION OF PRIOR ART

Offender monitoring systems allow offenders to serve a custodial sentence out of prison. The basic principle is that the offenders are wearing an electronic device, typically in the form of a bracelet, that communicates with a home station and/or a central monitoring station to provide information related to the offenders location, activity and status. Monitoring agents are monitoring the information and alarms received at the central monitoring station and take appropriate action when needed.

Various types of offender monitoring systems exist in the art.

Well known systems make use of an ankle bracelet that is to be worn at all times by the offender. The ankle bracelet repetitively sends a radio frequency signal to a home station located at the offender's home residence. The home station is in communication, generally through a phone line or across cellular network, with the central monitoring station. If the offender moves outside an allowed range from the home station, an alarm will be sent from the home station to the central monitoring station. A limitation of these type of offender monitoring systems is that they only provide information of the presence or non-presence of the offender at his home residence. When for example the offender is allowed to leave home at some moments defined by the monitoring agents, these systems cannot track the location of the offender when not at home.

More advanced offender monitoring systems make use of CPS technology to monitor the location of the offender. In addition of an ankle bracelet, the offender has to wear a portable GPS device when leaving his home residence. The portable GPS device allows the offender to leave his home residence while his location can be monitored by the central monitoring station.

An example of such an offender monitoring system where the offender has to wear both the ankle bracelet and the GPS device is described in U.S. Pat. No. 5,731,757. Further examples of such two-piece configurations are disclosed in for example U.S. Pat. No. 7,123,141B2 and U.S. Pat. No. 8,334,769 where the GPS functionalities of a GSM are used in combination with an ankle bracelet.

A disadvantage of these type of two-piece offender monitoring systems is that the offender has to wear two pieces of equipment. For example the offender has to wear an additional portable GPS device, such as a GSM. This is cumbersome and the offender can also forget or lose the additional GSM device or the GSM device can stop working when its battery is depleted.

In EP1363258, an electronic bracelet attachable to an offenders ankle is disclosed that is comprising an integrated GPS device and a wireless modem for communication through a wireless network with a central monitoring station. A processor is weighting location data obtained from the GPS with location data obtained through the wireless modem. A drawback of this offender monitoring system is that when auditive alarms are generated, the offender does not know what the cause of the alarm is and the GPS of the bracelet is not working optimally when being at home, inside a building.

In U.S. Pat. No. 6,405,213B1, a body worn location recording device (LRD) is disclosed comprising a GPS that is recording and storing the locations of an offender when wearing the LRD and walking outside his residence. When the offender is returned at his residence, the LRD can communicate through infrared technology with a device named RIU (residence interface unit) in order to transfer the location data stored in the memory of the LRD. The RIU device can then communicate with a central monitoring station through a telephone line to transfer data received from the LRD. A problem with this device is that it is a passive system only tracking and storing location data and the data are only transferred when the offender is returned at his residence.

In patent document US2010/238024, a remote tracking device (RTD), to be worn around an ankle of a person, and a monitoring center are disclosed. The RTD comprises a GPS and a wireless/cellular transceiver used for sending an alarm signal to the monitoring center through a cellular network in case of violation of access rules or other rules. A drawback of this RTD device is that when the wearer is performing a violation of a rule, the ankle bracelet can only inform the wearer through an auditive alarm. A further drawback of this device is that when the wearer is at home, the GPS does not always work and hence the tracking system cannot know if the wearer is effectively at home or not.

SUMMARY OF THE INVENTION

It is an object of the present invention to overcome the above discussed problems and to provide an offender monitoring system comprising an electronic bracelet that is robust and reliable and allows to responsibilize the offenders and to facilitate the tasks of the monitoring agents.

The present invention is defined in the appended independent (2 claim 1. 2

Preferred embodiments are defined in the dependent claims.

According to a first aspect of the invention, an electronic bracelet for monitoring an offender is provided. The electronic bracelet comprises a monitoring device, a strap configured for attaching the monitoring device to a wrist of the offender and a tamper detection device for detecting a bracelet attachment error.

The monitoring device comprises a number of components such as a geographic location determining device for determining a current location, a first communication module configured for wireless communication with a central monitoring station across a wide area network, a rechargeable battery, one or more computer-readable storage media, a screen, a date and time determining device configured for determining a current date and time, a second communication module configured for wireless communication with a home station across a local area network and a processor. The one or more computer-readable storage media comprise a computer program and offender configuration data defining home curfew rules and geographical restriction rules. The processor is adapted to execute the computer program.

The home curfew rules have to be construed as data that specify the date and time when the offender is authorized or not authorized to leave his home residence.

The geographical restriction rules have to be construed as data that specify specific geographical zones where the offender is not allowed to enter or where the offender is not allowed to enter at given date and time periods. Typically, so-called exclusion zones are defined where the offender is not allowed to enter or not allowed to enter at specific dates and time. An exclusion zone can for example be defined around a home residence of a victim.

Advantageously, the monitoring device comprises a housing enclosing the various components mentioned above. In this way, a single-piece device is formed that can be attached with a strap to the wrist of the offender. Hence, the offender cannot lose or forget any equipment to be worn related to the monitoring system and moreover the electronic bracelet being worn around the wrist has in this way the appearance of a watch.

Advantageously, the computer program comprises a first algorithm, when executed, to perform a step of transmitting a strap alarm signal to the central monitoring station using the first communication module to communicate with the monitoring station. In this way, whether the offender is at his home residence or whether he is outside his home residence, the monitoring station will always be informed of an error detected with respect to the attachment of the monitoring device to the wrist of the offender.

Advantageously, the computer program comprises a second algorithm, when executed, to perform a step of displaying the current date and time on the screen. In this way, the offender can at any moment look to the screen of his bracelet to inform himself of a date and time that is correct and undisputed. This is important in view of the home curfew rules the offender has to respect and which are associated to the knowledge of the correct date and time.

Advantageously, the computer program comprises a third algorithm, when executed, to monitor a number of situations related to the home curfew rules and geographical restriction rules and take appropriate action when violations of the rules are detected.

Indeed, the third algorithm comprises a step of verifying if the offender is authorized to leave home or not by comparing the current date and time, as obtained with the data and time determining device, with the home curfew rules.

The third algorithm further comprises steps of verifying if the second communication module can establish a communication connection with a home station across the local area network. In this way, the monitoring device can determine if the offender is at his home residence or not.

Depending if the offender is at his home residence or not, the third algorithm, when executed, will perform appropriate actions and verifications.

Indeed, if no communication connection can be established with the home station and if the offender is authorized to leave home, then the third algorithm, will periodically acquire the current location of the electronic bracelet with the geographical location determining device and compare the acquired current location with the geographical restriction rules. If a geographical restriction rule is violated then a first text message is displayed on the screen instructing the offender to for example move away from his current non-authorized location. Further, a geographical location violation signal is transmitted to the central monitoring station indicating an occurrence of a violation of the geographical restriction rules.

Advantageously, even if the offender is authorized to leave home, the monitoring device of the bracelet will verify if the offender is not violating any of the geographical restriction rules and instruct the offender with a message in case of violation of any of the rules. In this way, the offender can correct his mistake and for example walk away from a forbidden area. Hence, the monitoring agents do not need to take any action if the offender, following the instruction message on the screen of the bracelet, corrects his current location.

If no communication connection can be established with the home station and if the offender is not authorized to leave home, then the third algorithm, when executed, will perform a step of displaying a second text message on the screen instructing the offender for example to go home. In this way, the offender is informed of his fault related to a home curfew rule and he can correct his fault by going back to his home residence. If the offender has timely corrected his fault, the monitoring agents do not necessary have to take any action.

Advantageously, displaying instructions on the screen of the bracelet is easier and more reliable to communicate with offenders when compared to separate communication channels such as a GSM or e-mail, and which also require an action from the monitoring agents.

Advantageously, the bracelet according to the invention allows the offenders to handle some of the alarms by themselves and hence to responsibilize themselves. The instructions given automatically to the offender by the bracelet relieve the monitoring agents from performing simple tasks and make them thus more efficient.

In further embodiments, the computer program comprises a fourth algorithm, when executed, to perform steps of monitoring instruction text messages sent by the central monitoring station, and displaying the instruction text messages on the screen when received. Advantageously, the exchange of text messages between the electronic bracelet and the central monitoring station facilitates the interaction with the offender.

According to a second aspect of the invention, an offender monitoring system is provided comprising an electronic bracelet as claimed, a home station associated to the electronic bracelet and a central monitoring station.

The use of the term "processor" in this patent application has to be construed as a device that is adapted to execute a computer program. The term "computer program" has to be construed as a collection of programming instructions to be executed by the processor. The term "algorithm" has to be construed in the most general sense as being a sequence of programming instructions, when executed on the processor, results in one or more higher level functionalities. The term "step" or "steps" followed by one or more functional expressions, is to be interpreted as a representation of the one or more higher level functionalities resulting from the execution of an algorithm of the computer program.

SHORT DESCRIPTION OF THE DRAWINGS

Figure 2:
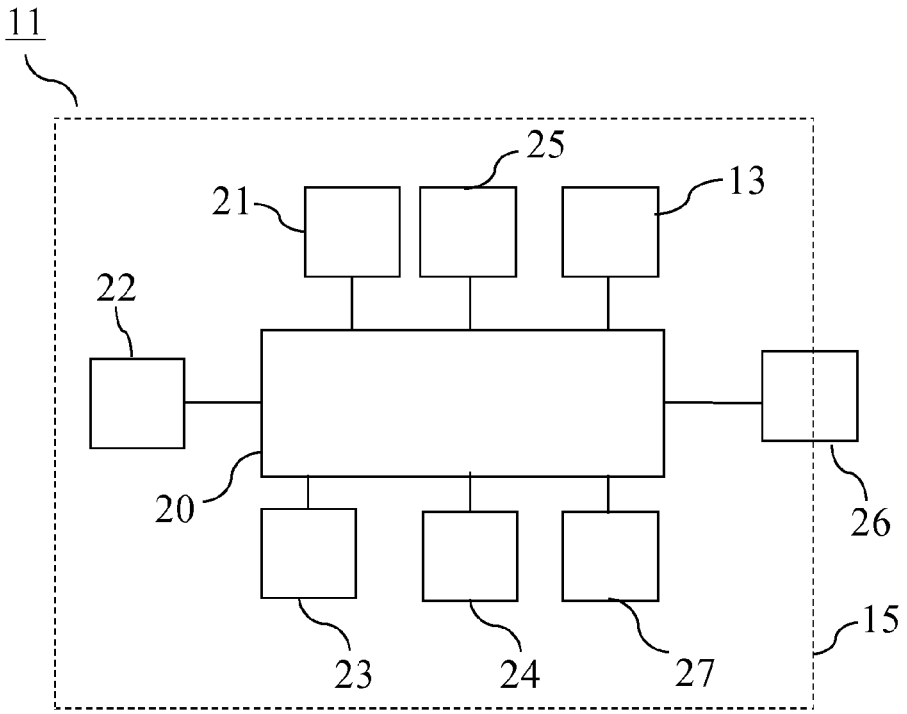
Figure 3:
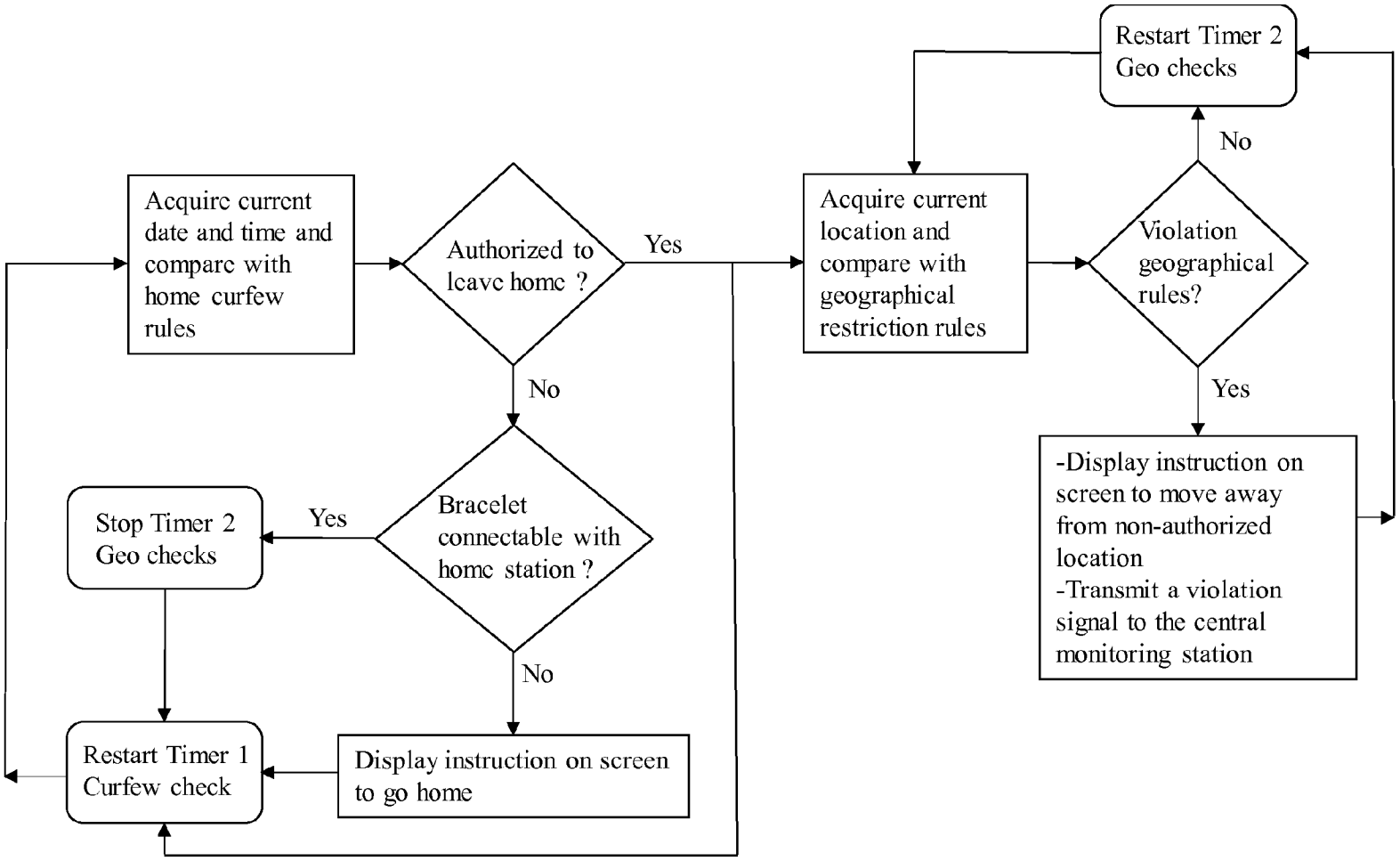
Figure 4:
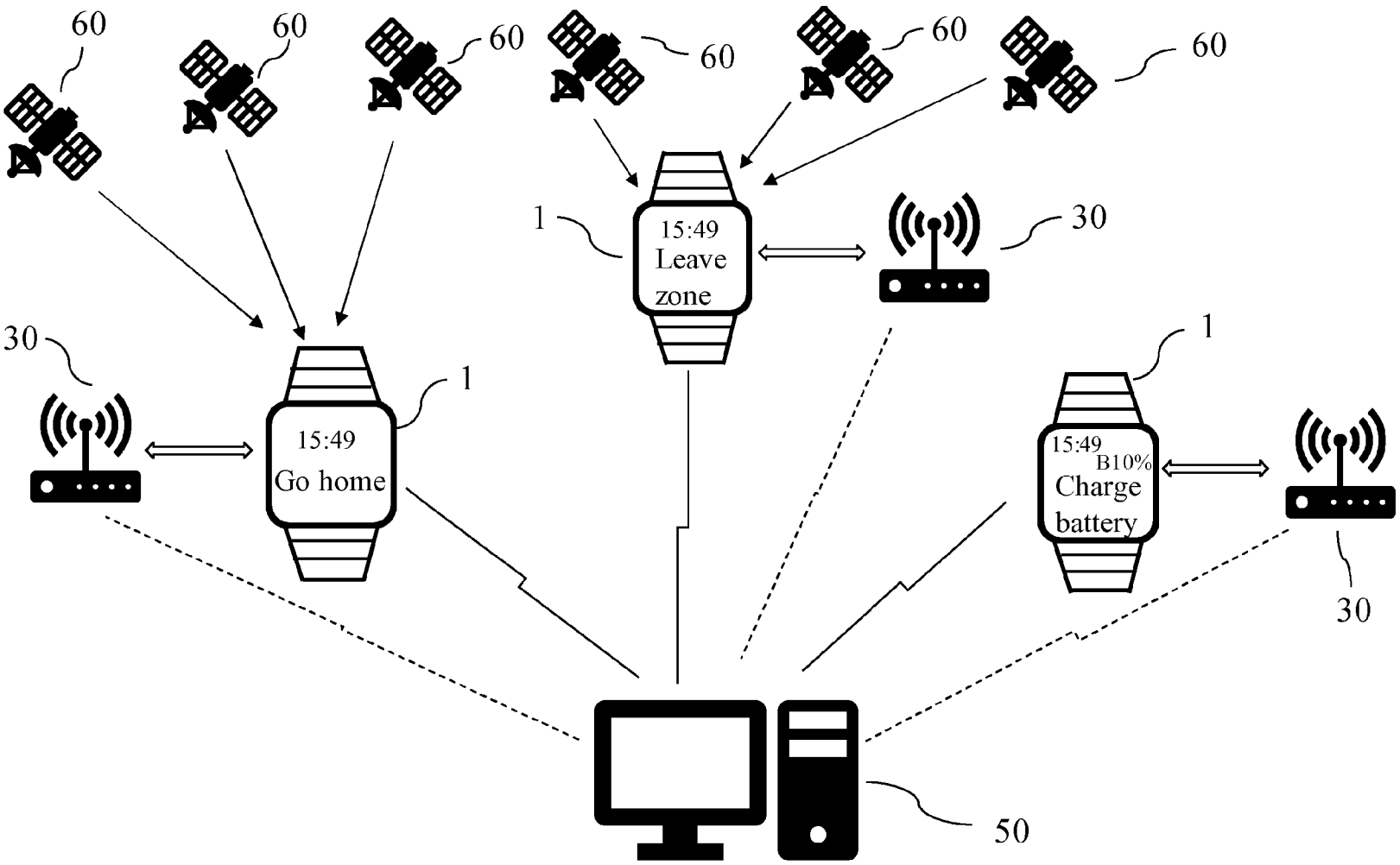

These and further aspects of the invention will be explained in greater detail by way of example and with reference to the accompanying drawings in which:

FIG. 1 schematically illustrates an electronic bracelet according to the invention, FIG. 2 schematically illustrates components of the monitoring device of the electronic bracelet, FIG. 3 illustrates an algorithm according to the invention, FIG. 4 schematically illustrates elements of an offender monitoring system according to the invention.

The figures are not drawn to scale. Generally, identical components are denoted by the same reference numerals in the figures.

DETAILED DESCRIPTION OF PREFERRED EMBODIMENTS

According to a first aspect of the invention, an electronic bracelet 1 for monitoring an offender is provided, as schematically illustrated on FIG. 1. The electronic bracelet 1 comprises a monitoring device 11 and a strap 12 configured for attaching the monitoring device 11 to a wrist of the offender.

As schematically illustrated on FIG. 2, the monitoring device 11 comprises a housing 15 for enclosing components of the monitoring device. The housing 15 encloses a geographic location determining device 25 for determining a current location, a first communication module 23 configured for wireless communication with a central monitoring station across a wide area network, a second communication module 24 configured for wireless communication with a home station across a local area network, a rechargeable battery 22, one or more computer-readable storage media 21 comprising offender configuration data defining home curfew rules and geographical restriction rules and comprising a computer program, a data and time determining device 27 configured for determining a current date and time and a processor 20 adapted for executing the computer program. The monitoring device 11 also comprises a screen 13 that is coupled to the housing 15.

The wide area network used by the first communication module 23 for wireless communication with the central monitoring station, is for example a GSM network. In embodiments, the first communication module 23 comprises a GSM modem with an associated SIM card, known in the art. The first communication module 23 comprises a first antenna for receiving GSM signals from the GSM network. In some embodiments, the first communication module 23 is adapted to operate at different GSM frequency bands.

The second communication module 24 configured for wireless communication with a home station across a local area network comprises for example a beacon receiver unit or a beacon transceiver unit that is based on Bluetooth or LoRa technology, known in the art. Alternatively, the local area network is a wifi network. The second communication module 24 generally comprises a second antenna.

The geographic location determining device 25 for determining a current location comprises for example a global positioning satellite (GPS) receiver for providing position information to the processor.

Modules for GSM communication through the GSM network, modules for communication through a local network based on Bluetooth or LoRA and GPS receiving modules are commercially available from various suppliers and these modules are compact in size and are currently used for multiple applications such as for example IoT (internet of things) devices and smartwatch devices.

The electronic bracelet 1 also comprises a tamper detection device for detecting a bracelet attachment error. As will be further discussed below, depending on the type of tamper detection device, the tamper detection device can either be enclosed by the housing 15 of the monitoring device 11 or partly be enclosed by the housing 15 and partly be enclosed inside the strap 12.

The computer program comprises a first algorithm, when executed, to perform a step of transmitting a strap alarm signal to the central monitoring station when an attachment error is detected by the tamper detection device. As discussed above, the monitoring device is thereby using the first communication nodule 23 for communicating with the central monitoring station.

The data and time determining device 27 configured for determining a current date and time typically comprises a real-time clock (RTC) based on a quartz crystal oscillator and a synchronization unit for regularly synchronizing this real-time clock with international standardized time keepers. The international standardized time keepers can be obtained using the first communication module when making a wide area network connection. Another way of determining current date and time is by using the information given by the geographic location determining device 25.

The computer program comprises a second algorithm, when executed, to perform a step of displaying the current date and time on the screen 13 as determined by the data and time determining device 27.

The computer program further comprises a third algorithm, when executed, to perform a step of verifying if the second communication module 24 can establish a communication connection with the home station across the local area network. If for example the second communication module 24 does not receive a beacon from the home station, it is concluded that no communication can be established and hence that the bracelet is outside the communication range of the second communication module 24.

The third algorithm, when executed, also performs a step of verifying if the offender is authorized to leave home or not by comparing the current date and time with the home curfew rules. Indeed, as the home curfew rules are stored in one of the one or more computer-readable storage media of the monitoring device and as the current date and time are known by the monitoring device, the third algorithm can determine if the offender is authorized to leave home or not, i.e. verifying if there is violation of the home curfew rules, by making a date and time comparison between the actual date and time and the configuration data defining the home curfew rules as discussed above.

If no communication connection can be established with the home station and if the offender is authorized to leave home then the third algorithm performs a step of periodically acquiring the current location of the electronic bracelet with the geographical location determining device 25 and comparing the acquired current location with the geographical restriction rules.

If a geographical restriction rule is violated then a first text message is displayed on the screen 13 instructing the offender to take a first action, such as for example an instruction to move away from his current non-authorized location. Further, in case of such a violation related to the geographical zone, a geographical location violation signal is transmitted to the central monitoring station indicating an occurrence of a violation of the geographical restriction rules. The detection of a violation of the geographical restriction rules is made by comparing the current location with the configuration data defining the geographical restriction rules as discussed above.

In embodiments, the geographical location violation signal sent to the central monitoring station is a message such as a text message or a code. Typically, the message comprises information indicating the type of alarm and time of occurrence. When the message is in the form of a code, the central monitoring station will interpret this code and display the appropriate message on a display of the central monitoring station.

If no communication connection can be established with the home station and if the offender is not authorized to leave home then a second text message is displayed on the screen 13, instructing the offender to take a second action, such as for example an instruction to go home.

In embodiments, the text messages displayed on the screen following a violation of the geographical restriction rules or the home curfew rules, are pre-defined text messages that are stored in one of the one or more computer-readable storage media 21 of the monitoring device. In preferred embodiments, the monitoring device 11 is also configured to additionally generate a vibrating alarm and/or an auditive alarm when a violation of the geographical restriction rules or the home curfew rules occurs.

An exemplary flow chart of the third algorithm is schematically illustrated on FIG. 3. Advantageously, the check related to the geographical restrictions can be stopped if the offender is at home in order to limit the power consumption by the GPS. In embodiments, as illustrated on FIG. 3, a first timer and a second timer can be used to define a time period for repeating the home curfew check and the geographical restriction check, respectively. For example, the home curfew check can be performed every 3 minutes while the geographical location check, when the offender is outside his home residence, can be performed every minute. The frequency for performing a check is for example defined by parameters stored in one of the one or more computer-readable storage media 21 of the monitoring device. When the offender is at his home residence, the second timer can be stopped as no checks with respect to the geographical rules need to be performed.

In embodiments, the housing 15 is for example made of a plastic material such as polypropylene or polycarbonate, or alternatively the housing can be made of stainless steel or a metal. An O-ring can be provided between the housing 15 and the screen 13 in order to form a waterproof monitoring device 11.

The screen 13 of the monitoring device has to be construed as a graphical user interface for displaying information to the offender. The screen 13 is for example a liquid crystal display (LCD), known in the art and available from various suppliers. The LCD display has for example a size of about 32 mm by 34 mm.

The strap 12 typically comprises a connector at each end of the strap that is fixed to the monitoring device 11. The length of the strap is generally defined at the moment when the electronic bracelet is attached to the offender. The strap is flexible and is typically made of a plastic or a rubber material.

The rechargeable battery is for example a lithium ion battery of 3.6 V having a box-shape of for example 31 mm by 35 mm with a thickness of 5 mm. These batteries are known in the art and available from various suppliers.

To charge the rechargeable battery, an external recharger is to be used. For example, a charging cradle is clipped on the watch. This charging cradle is connected to an external portable battery. This external portable battery recharges the rechargeable battery 22 through the cradle.

As discussed above, the one or more computer-readable storage media 21 comprise besides the offender configuration data also the computer program comprising the various algorithms executed by the processor 20. The configuration data and computer program can be downloaded either through an interface port of the monitoring device or the configuration data and computer program can be downloaded from the central monitoring station using the first communication module 23 for wireless communication with the central monitoring station.

The one or more computer-readable storage media can comprise various types of storage media such as for example a random access memory (RAM), a read-only memory (ROM), a flash memory or an EEPROM memory.

The processor 20 has to be construed as a device adapted for executing the programming instructions of the computer program stored in the memory of the one or more computer-readable storage media. The processor can also be named a core, or a core processor or a central processing unit.

In embodiments, the processor is part of a microcontroller unit (MCU) which can be interpreted as a small computer on a single integrated circuit comprising at least one processor and one or more types of memory.

Microcontrollers that can be used for the current application are known in the art and available from various suppliers, such as for example an Ambiq Micro Appollo 2 MCU which is for example used for IoT applications.

In further embodiments, the one or more computer-readable storage media 21 comprises both an external memory that is external to the microcontroller and an internal memory that is embedded in the microcontroller. In embodiments, the one or more computer-readable storage media 21 consists for example of an embedded memory of 1 MB Flash and 256 KB RAM, an external flash memory of 1 MB and a EEPROM of 128 KB.

In embodiments the monitoring device 11 comprises a customized printed circuit board adapted to accommodate the processor, the one or more computer-readable storage media 21, the data and time determining device 27 and the first 23 and second 24 communication module.

In preferred embodiments, if no communication can be established with the home station and if the offender is not authorized to leave home, then the third algorithm, when executed, also performs a step of transmitting a curfew violation signal to the central monitoring station indicating an occurrence of a violation of the curfew rules. In alternative embodiments, as will be further discussed below, if a curfew violation occurs, the home station can transmit a curfew violation signal to the central monitoring station.

As discussed above, the second communication module 24 comprises a receiver for receiving an RF signal from the home station. In embodiments, the verification if the second communication module 24 can establish a communication connection with the home station or not, is performed by comparing the RF signal with a detection threshold level. If the RF signal is below the detection threshold level, no communication connection with the home station is assumed. In these preferred embodiments, the second communication module 24 can for example use a lower-power Bluetooth (e.g. version 4.2) while the home station uses a high-power Bluetooth (e.g. version 5) to be able to emit an RF signal (beacon) at a sufficiently large distance (for example 10 m or more). In this way the power consumption of the rechargeable battery 22 of the monitoring device 11 can be reduced.

In further embodiments, the computer program comprises a fourth algorithm, when executed, to perform steps of monitoring instruction text messages or information text messages sent by the central monitoring station, and displaying the instruction or text messages on the screen when received.

In embodiments, the first communication module 23 is configured for receiving HTTPS (Hypertext Transfer Protocol Secure) data from the central monitoring station, thereby using a dedicated data communication protocol. This data communication protocol, when executed, comprises steps of i) monitoring a command SMS from the central monitoring station requesting to send the HTTPS data to the electronic bracelet;
ii) activating the first communication module 23 for sending and receiving HTTPS data;
iii) informing the central monitoring station to be ready for receiving the HTTPS data;
iv) receiving the HTTPS data from the central monitoring station;
v) deactivating the first communication module 23 for sending and receiving HTTPS data.

In this way, the power consumption of the rechargeable battery can be limited as the first communication module 23 only needs to be activated for HTTPS data communication when the central monitoring station has send a request. Examples of HTTPS data that are transmitted using the above discussed communication protocol are custom text messages, configuration information, time and date settings, updated curfew or appointments.

The tamper detection device comprises one or more sensors for detecting if the electronic bracelet is no longer correctly attached to the wrist of the offender. The offender could for example cut or remove the strap or try to glide the electronic bracelet over his wrist. Therefore, the tamper detection device comprises at least a first sensor configured for sensing if the strap is cut or removed. The first sensor comprises for example a signal transmission line embedded within the strap, a signal emitter at one end of the signal transmission line for sending a signal and a signal receiver at an opposite end for receiving the transmitted signal. If the signal receiver does not receive any signal anymore, this indicates that the strap is disconnected. A signal transmission line is for example an optical fiber and the signal is in such case a light signal sent through the optical fiber.

In embodiments, the tamper detection device comprises a second sensor configured for detecting a proximity of a skin when the electronic bracelet 1 is attached to an offender. Such type of sensors for detecting a proximity are known in the art and are based on capacitive sensor technology. With this additional second sensor, the offender cannot remove the bracelet by gliding the bracelet over his wrist without being detected.

In further embodiments, a third sensor configured for sensing tampering of the housing 15 is used. This can for example be a contact sensor that detects that the screen coupled to the housing is removed or that detects that a cover of the housing is removed.

The tamper detection device can also be implemented by using one or more timers that drive the repetition of the performance of the various tamper detection checks.

In some embodiments, the monitoring device 11 comprises an accelerometer and/or a gyroscope, also enclosed in the housing 15. This allows to verify if the offender is for example moving or not.

Preferably, the computer program comprises a fifth algorithm, when executed to perform a step of repetitively displaying a current battery charge status of the rechargeable battery 22 on the screen 13. This allows the offender to for example charge his bracelet before leaving his home residence when he observes that the battery charge status is low or when being outside his residence, to come back home earlier in order to charge the battery of the bracelet. The fifth algorithm, when executed, also performs a step of displaying a third text message on the screen 13 if the current battery charge status is below a battery-low threshold value and thereby instructs the offender to charge the rechargeable battery 22. The battery-low threshold value is a configuration parameter that is for example stored in a memory of the one or more computer-readable storage media of the monitoring device 11. In embodiments, besides the generation of the instruction on the screen, also a vibrating alarm and/or an auditive alarm can be generated if the battery charge status is below the battery-low threshold value.

The monitoring device 11 preferably also comprises a button 14 coupled to the housing 15 or coupled to the screen 13. This button 14 is linked with the processor 20 and configured for allowing the offender to perform an acknowledge action if a text message is displayed on the screen. The acknowledge action allows the offender to erase the instruction message from the screen 13 and in case there is a vibrating alarm and/or an auditive alarm, stop the vibration and/or auditive alarm.

Generally, the electronic bracelet according to the invention transmits data on a regular basis to the central monitoring station. Therefore, in such embodiments, the computer program comprises a sixth algorithm, when executed, to perform a step of periodically establishing a communication connection with the central monitoring station for transmitting data and a further step of transmitting data to the central monitoring station. At least the following data are transmitted to the central monitoring station: acquired current locations as obtained during a given time period, an alarm information indicating any occurrence of a violation of the geographical restriction rules or a violation of the home curfew rules during said given time period, an acknowledgement information indicating any occurrence of an acknowledgement action during said given time period and an unique ID associated to the electronic bracelet. Preferably, also the battery status is part of the data transmitted to the central monitoring station.

In embodiments, the one or more computer-readable storage media 21 of the monitoring device 11 also comprises offender agenda data. In these embodiments, the computer program comprises a seventh algorithm, when executed, to perform a step of displaying the offender agenda data on the screen 13 following a request made by the offender. This request can be made using one or more further buttons coupled to said housing 15 or coupled to the screen 13. In this way, general information can be visualized to the offender such as for example the offenders curfew of the current and next days or his appointments.

According to a second aspect of the invention, an offender monitoring system 100 is provided. Some elements of the offender monitoring system are schematically illustrated on FIG. 4. The offender monitoring system 100 comprises a central monitoring station 50, one or more of the electronic bracelets 1 as discussed above and for each electronic bracelet 1 an associated home station 30. The home station 30 is located at the residence of the offender and is configured for making a wireless communication with the second communication module 24 of the electronic bracelet 1 to which it is associated, thereby using a local area network as discussed above. The central monitoring station 50 is configured for making a wireless communication with the first communication module 23 of each of the electronic bracelets 1 across the wide area network. As discussed above, the monitoring device 11 of each of the bracelets 1 comprises a geographic location determining device 25 for determining a current location. Typically the geographic location determining device 25 comprises a GPS receiver for receiving data from satellites 60 to determine the position of the bracelet.

The central monitoring station typically comprises one or more computers and a user interface. The central station is configured to receive alarms signals from the electronic bracelet and/or home station and display information or instructions for the monitoring agents. The monitoring agent at the central station can also send instruction text messages to the electronic bracelet of the offender by for example manually entering text messages using the user interface of the central monitoring station.

The home curfew rules and the geographical restriction rules stored in the electronic bracelet can be updated by the central monitoring station using the wireless wide are communication network.

The home station is used to monitor the offender when he is at his home residence. The home station typically comprises an RF emitter and receiver, for example based on Bluetooth technology, for communicating with the electronic bracelet to which it is associated. The home station can be associated to more than one electronic bracelet.

In embodiments, the home station 30 is further configured for making a wireless communication with the central monitoring station 50 across the wide area network. In this way, home curfew violations can also be communicated to the central monitoring station through the home station 30 instead of through the electronic bracelet 1.

The present invention has been described in terms of specific embodiments, which are illustrative of the invention and not to be construed as limiting. It will be appreciated by persons skilled in the art that the present invention is not limited by what has been particularly shown and/or described above and that alternatives or modified embodiments could be developed in the light of the overall teaching of this disclosure. Use of the verb "to comprise", as well as the respective conjugations, does not exclude the presence of elements other than those stated. Use of the article "a", "an" or "the" preceding an element does not exclude the presence of a plurality of such elements.

The invention claimed is:

1. An electronic bracelet (1) for monitoring an offender comprising a monitoring device (11), a strap (12) for attaching the monitoring device (11) to a wrist of the offender and a tamper detection device for detecting a bracelet attachment error, and wherein said monitoring device (11) comprises a housing (15) and a screen (13) coupled to said housing (15), said housing (15) enclosing a geographic location determining device (25) for determining a current location;

a rechargeable battery (22);

one or more computer-readable storage media (21) comprising i) offender configuration data defining home curfew rules and geographical restriction rules, and ii) a computer program;

a processor (20) adapted to execute said computer program; and a data and time determining device (27) configured for determining a current date and time; characterized in that said housing (15) further encloses a first communication module (23) configured for wireless communication with a central monitoring station across a wide area network; and a second communication module (24) configured for wireless communication with a home station across a local area network;

and in that said computer program comprises a first algorithm, when executed, to perform a step of transmitting a strap alarm signal to said central monitoring station if a bracelet attachment error is detected by said tamper detection device;

a second algorithm, when executed, to perform a step of displaying said current date and time on said screen (13); and a third algorithm, when executed, to perform steps of a) verifying if the offender is authorized to leave home or not by comparing the current date and time with the home curfew rules;

b) verifying if said second communication module (24) can establish a communication connection with said home station across said local area network;

c) if no communication connection can be established with the home station and if the offender is authorized to leave home then periodically acquiring the current location of the electronic bracelet with said geographical location determining device (25), comparing the acquired current location with said geographical restriction rules and if a geographical restriction rule is violated then i) displaying a first text message on said screen (13) instructing the offender to take a first action, and ii) transmitting a geographical location violation signal to said central monitoring station indicating an occurrence of a violation of the geographical restriction rules; and d) if no communication connection can be established with the home station and if the offender is not authorized to leave home then i) displaying a second text message on said screen (13) instructing the offender to take a second action.

2. The electronic bracelet (1) according to claim 1 wherein said third algorithm, when executed, performs a step of d) ii) transmitting a curfew violation signal to said central monitoring station indicating an occurrence of a violation of said curfew rules.

3. The electronic bracelet (1) according to claim 1 wherein said second communication module (24) comprises a receiver for receiving an RF signal from said home station and wherein said verifying if said second communication module (24) can establish a communication connection with said home station in step b) of said third algorithm is performed by comparing said RF signal with a detection threshold level and wherein no communication connection with the home station is assumed if said RF signal is below said detection threshold level.

4. The electronic bracelet (1) according to claim 1 wherein said computer program comprises a fourth algorithm, when executed, to perform steps of monitoring instruction text messages sent by said central monitoring station, and displaying said instruction text messages on said screen (13) when received.

5. The electronic bracelet (1) according to claim 1 wherein said first communication module (23) is configured for receiving HTTPS data from said central monitoring station through a data communication protocol, and wherein said data communication protocol when executed comprises steps of i) monitoring a command SMS from said central monitoring station requesting to send said HTTPS data to said electronic bracelet;

ii) activating the first communication module (23) for sending and receiving HTTPS data;

iii) informing said central monitoring station to be ready for receiving said HTTPS data;

iv) receiving said HTTPS data from said central monitoring station; and v) deactivating the first communication module (23) for sending and receiving HTTPS data.

6. The electronic bracelet (1) according to claim 1 wherein said tamper detection device comprises a first sensor configured for sensing if said strap is cut or removed.

7. The electronic bracelet according to claim 6 wherein said tamper detection device comprises a second sensor configured for detecting a proximity of a skin when said electronic bracelet (1) is attached to an offender and/or a third sensor configured for sensing tampering of said housing (15).

8. The electronic bracelet (1) according to claim 1 wherein said monitoring device (11) comprises an accelerometer and/or a gyroscope enclosed in said housing (15).

9. The electronic bracelet (1) according to claim 1 wherein said computer program comprises a fifth algorithm, when executed, to perform steps of repetitively displaying a current battery charge status of said rechargeable battery (22) on said screen (13), and if the current battery charge status is below a battery-low threshold value then displaying a third text message on said screen (13) instructing the offender to charge the rechargeable battery (22).

10. The electronic bracelet (1) according to claim 1 wherein said monitoring device (11) comprises a button (14) coupled to said housing (15) or coupled to said screen (13), and wherein said button (14) is linked with said processor (20) and configured for allowing the offender to perform an acknowledge action if a text message is displayed on said screen.

11. The electronic bracelet according to claim 10 wherein said computer program comprises a sixth algorithm, when executed, to perform steps of periodically establishing a communication connection with the central monitoring station (50) for transmitting data;

transmitting at least the following data to said central monitoring station: acquired current locations as obtained during a given time period, an alarm information indicating any occurrence of a violation of the geographical restriction rules or a violation of the home curfew rules during said given time period, an acknowledgement information indicating any occurrence of an acknowledgement action during said given time period and an unique ID associated to the electronic bracelet.

12. The electronic bracelet (1) according to claim 1 wherein said geographic location determining device (25) comprises a global positioning satellite receiver.

13. The electronic bracelet (1) according to claim 1 wherein said one or more computer-readable storage media (21) further comprises offender agenda data, and wherein said computer program comprises a seventh algorithm, when executed, to perform a step of displaying said offender agenda data on said screen (13) following a request made by the offender using one or more further buttons coupled to said housing (15) or coupled to said screen (13).

14. An offender monitoring system comprising:

an electronic bracelet (1) according to claim 1;

a home station (30) associated to said electronic bracelet (1) and configured for making a wireless communication with said second communication module (24) of said electronic bracelet (1) across said local area network;

a central monitoring station (50) configured for making a wireless communication with said first communication module (23) of said electronic bracelet (1) across said wide area network.

15. The offender monitoring system according to claim 14 wherein said home station (30) is further configured for making a wireless communication with said central monitoring station (50) across said wide area network.

* * * * *